US012509886B2

(12) United States Patent
Swain

(10) Patent No.: US 12,509,886 B2
(45) **Date of Patent: *Dec. 30, 2025**

(54) WATER DRAINAGE SYSTEM

(71) Applicant: Ben Swain, Suwanee, GA (US)

(72) Inventor: Ben Swain, Suwanee, GA (US)

( * ) Notice: Subject to any disclaimer, the term of this patent is extended or adjusted under 35 U.S.C. 154(b) by 171 days.

This patent is subject to a terminal disclaimer.

(21) Appl. No.: 18/433,666

(22) Filed: Feb. 6, 2024

(65) Prior Publication Data

US 2024/0175274 A1 May 30, 2024

Related U.S. Application Data

(63) Continuation-in-part of application No. 17/864,113, filed on Jul. 13, 2022, now Pat. No. 12,134,890.

(51) Int. Cl.
*E04F 17/00* (2006.01)

(52) U.S. Cl.
CPC ..... *E04F 17/00* (2013.01)

(58) Field of Classification Search
CPC ..... E04B 1/62; E04B 1/003; E04B 1/0007; E03F 3/046; E04F 17/00
See application file for complete search history.

(56) References Cited

U.S. PATENT DOCUMENTS 4,663,894 A * 5/1987 LaRoche ..... E04D 13/064 405/118
4,860,502 A * 8/1989 Mickelsen ..... E04D 3/30 52/11
5,511,351 A * 4/1996 Moore ..... E04B 1/003 52/302.1
5,765,328 A * 6/1998 Moore ..... E04B 1/003 52/302.1
6,212,837 B1 * 4/2001 Davis ..... E04D 13/0477 52/302.1
6,308,479 B1 * 10/2001 Prohofsky ..... E04B 9/02 52/302.1
6,314,684 B1 * 11/2001 Aviram ..... F16B 5/0692 52/11
6,343,450 B1 * 2/2002 Vance, Jr. ..... E04B 9/30 52/302.1
6,393,785 B1 * 5/2002 Burt ..... E04F 17/00 52/302.1
6,415,571 B2 * 7/2002 Risser ..... E04F 15/02183 52/302.1
6,688,059 B1 * 2/2004 Walker ..... E04D 13/0477 52/847

(Continued)

*Primary Examiner* — Rodney Mintz
(74) *Attorney, Agent, or Firm* — PATENTFILE, LLC; Bradley C. Fach; Steven R. Kick

(57) ABSTRACT

A water drainage system may include a base clip and cover clip that may be engaged to one or more rails so that one or more portions of a waterproof membrane may be tensioned or compressed between the clips and rails. A base clip may include a base ridge that may be received in a base channel of a cover clip, preferably with a portion of the waterproof membrane disposed and coupled between the cover clip and the base clip. The cover clip may be coupled to the rail by inserting a second cover ridge of the cover clip into a cover channel of the rail and by inserting a rail ridge of the rail into a rail channel of the cover clip. The rail may be coupled to a portion of a deck to couple the rail, base clip, cover clip, and waterproof membrane to the deck.

20 Claims, 6 Drawing Sheets

(56) References Cited

U.S. PATENT DOCUMENTS 7,434,358 B2 * 10/2008 Smith ..... E04B 1/34342 52/302.1
8,627,624 B2 * 1/2014 Stockton ..... B25B 23/00 52/468
9,187,911 B2 * 11/2015 Bowman ..... E04D 13/0477
9,353,532 B2 * 5/2016 Peterson ..... E04F 15/02183
9,353,534 B2 * 5/2016 Peterson ..... E04D 13/0477
9,644,364 B2 * 5/2017 Bowman ..... E04F 15/02183
10,590,662 B2 * 3/2020 Peterson ..... E04B 1/003
10,793,049 B2 * 10/2020 Alexander ..... B60P 7/04
10,844,615 B2 * 11/2020 Esh, Jr. ..... E04B 1/003
10,988,943 B2 * 4/2021 Peterson ..... E04B 1/003
11,499,323 B2 * 11/2022 Peterson ..... E04F 17/00
12,134,890 B2 * 11/2024 Swain ..... E03F 3/046
2005/0252151 A1 * 11/2005 Kindred ..... E04F 17/00 52/650.3
2006/0162262 A1 * 7/2006 Smith ..... E04B 1/34342 52/58
2009/0266018 A1 * 10/2009 Stockton ..... E04F 17/00 52/302.3
2015/0033649 A1 * 2/2015 Peterson ..... E04F 17/00 52/302.1
2015/0033650 A1 * 2/2015 Peterson ..... E04D 13/0477 52/741.1
2015/0300014 A1 * 10/2015 Bowman ..... E04B 1/003 52/302.1
2016/0069092 A1 * 3/2016 Bowman ..... E04F 17/00 52/705
2018/0080236 A1 * 3/2018 Peterson ..... E04B 1/003
2018/0363306 A1 * 12/2018 Esh, Jr. ..... E04F 17/00
2019/0225136 A1 * 7/2019 Alexander ..... F16B 2/22
2020/0354975 A1 * 11/2020 Peterson ..... E04F 17/00
2022/0042323 A1 * 2/2022 Peterson ..... E04F 17/00
2024/0018774 A1 * 1/2024 Swain ..... E03F 3/046

* cited by examiner

WATER DRAINAGE SYSTEM

CROSS REFERENCE TO RELATED APPLICATIONS

This application is a continuation-in-part of U.S. Non-Provisional application Ser. No. 17/864,113, filed on Jul. 13, 2022, entitled "WATER DRAINAGE SYSTEM", which is hereby incorporated by reference in its entirety.

FIELD OF THE INVENTION

This patent specification relates to the field of water drainage and diversion systems. More specifically, this patent specification relates to a water drainage system which may be attached below structures, such as residential and commercial decks, to direct and divert water draining through the deck.

BACKGROUND

Currently there are no reliable, cost-effective systems to create a dry space under a residential or commercial wood deck. The most common existing systems utilize plastic panels which may be purchased from a home supply store. However, these are hard to install, get clogged easily, and have to be taken down to clean. Additionally, an individual needs to be skilled to install these panels and have the tools, ladders, and other specialized tools to do the work. The other existing options are expensive and need to be installed before the deck boards are put on. Very few can be installed on an existing deck, and they cannot be easily cleaned or replaced if damaged. While some people resort to using fully finished ceilings, these are very expensive ($12-$14 sq. ft installed) and are in different product categories since these are chosen for aesthetics to give a finished ceiling look.

Therefore, a need exists for novel water drainage and diversion systems. A further need exists for novel water drainage systems which may be attached below structures, such as residential and commercial decks, to direct and divert water draining through the deck. There is also a need for novel water drainage and diversion systems which do not suffer from the above-mentioned drawbacks of existing systems.

BRIEF SUMMARY OF THE INVENTION

A water drainage system is provided which may include one or more clips that may be engaged, and more preferably removably engaged, to one or more rails so that one or more portions of a waterproof membrane may be tensioned or compressed between the clips and rails. The system may be configured to direct and divert water, such as water that may drain through a deck. Preferably, the rails may be installed with fasteners on each side of the joists that support the deck and may be angled down (preferably down one inch of slope every four feet) to where water will feed into a gutter or other location. Preferably, rails may be approximately four feet long and may be installed or coupled to the interior side of each deck joist and are hidden from view because they are recessed between each joist. A lightweight synthetic tear-proof and waterproof membrane may be coupled to the rails via the clips to create a "hammock" like gutter between adjacent joists. The waterproof membrane may be secured in place by clips, such as every eighteen inches. The clips hold the waterproof membrane firmly in the channel of the rails, but can be easily removed. Removing the clips will free the waterproof membrane to allow for easy cleaning of any debris that may accumulate over time on the waterproof membrane or to replace the waterproof membrane if damaged.

In some embodiments, a water drainage system may include a rail, a base clip, and a cover clip that may be coupled together. The rail may have a back plate, a central plate, a rail ridge, a cover channel, and a lower plate. The central plate may be coupled to the back plate and may extend away from the back plate, and the lower plate may be coupled to the back plate and may extend away from the back plate. The rail ridge may be coupled to the lower plate so that the rail ridge extends towards the central plate, and the cover channel may be formed between the rail ridge, the back plate, the central plate, and the lower plate. A base clip may have a base plate, a base ridge, a base upper surface, and the base plate may include a first end and a second end. The base upper surface and the base ridge may be disposed on opposite sides of the base plate, and the base ridge may extend away from the base plate. A cover clip may have a cover top plate, a cover bottom plate, a first cover ridge, a second cover ridge, a rail channel, a base channel, and a clip channel, and the cover clip may be configured to be coupled to the base clip and to the rail. The cover top plate and the cover bottom plate may be coupled together at a cover junction, and the clip channel may be formed between the cover top plate and the cover bottom plate. The first cover ridge may be coupled to the cover bottom plate so that the first cover ridge extends towards the cover top plate, and the base channel may be formed between the cover bottom plate and the first cover ridge. The first cover ridge and the second cover ridge may be coupled to opposing sides of the cover bottom plate, and the rail channel may be formed between the cover bottom plate and the second cover ridge.

In further embodiments, the system may include a waterproof membrane, and the waterproof membrane may be coupled to the cover clip and the base clip when the waterproof membrane is positioned between the cover clip and the base clip and when the cover clip and the base clip are coupled together.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
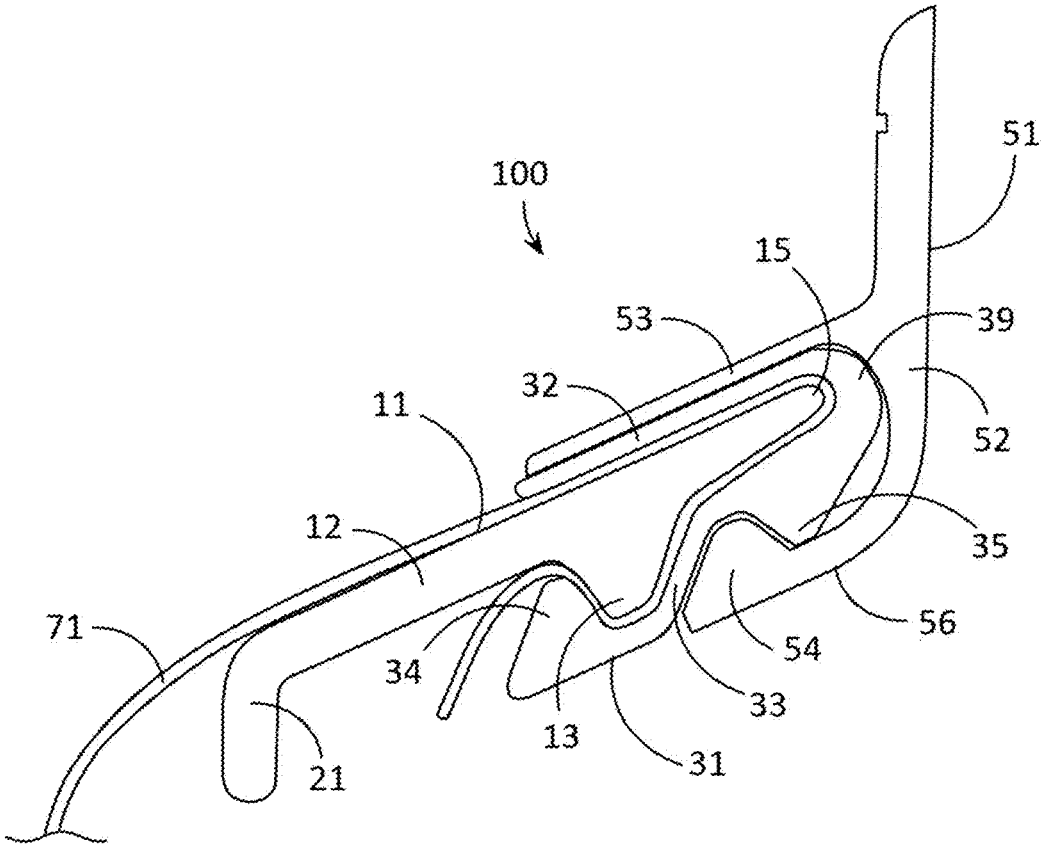
FIG. 1 depicts a side elevation view of an example of a water drainage system having an optional waterproof membrane according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 15% of the specified number. Additionally, as used in this application, the term "substantially" means that the actual value is within about 10% of the actual desired value, more preferably within about 5% of the actual desired value and even more preferably within about 1% of the actual desired value of any variable, element or limit set forth herein.

A new water drainage system is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-9 illustrate various components and examples of a water drainage system ("the system") 100 according to various embodiments. In some embodiments, the system 100 may comprise a plurality of base clips 11 and cover clips 31 that may be engaged, and more preferably removably engaged, to a plurality of rails 51 so that one or more portions of a waterproof membrane 71 may be tensioned or compressed between the clips 11, 31, and rails 51.

Figure 2:
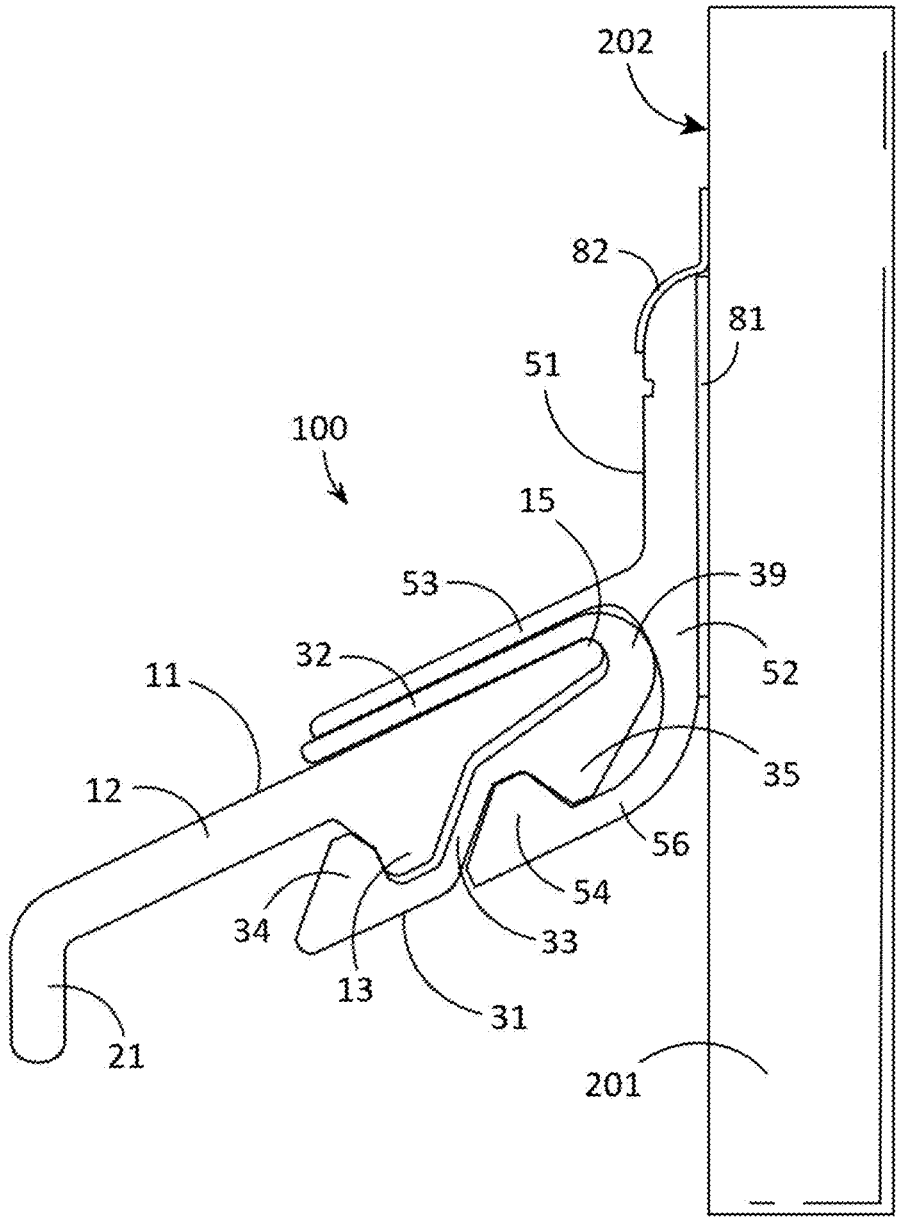
FIG. 2 illustrates a side elevation view of an example of a water drainage system, without an optional waterproof membrane, coupled to an example deck joist according to various embodiments described herein.
Figure 3:
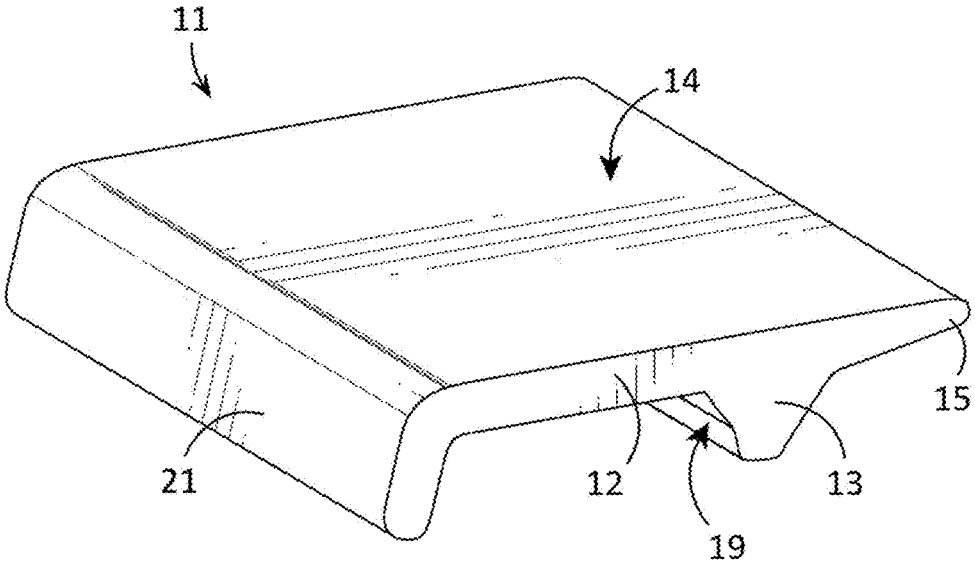
FIG. 3 shows a top perspective view of an example of a base clip according to various embodiments described herein.
Figure 4:
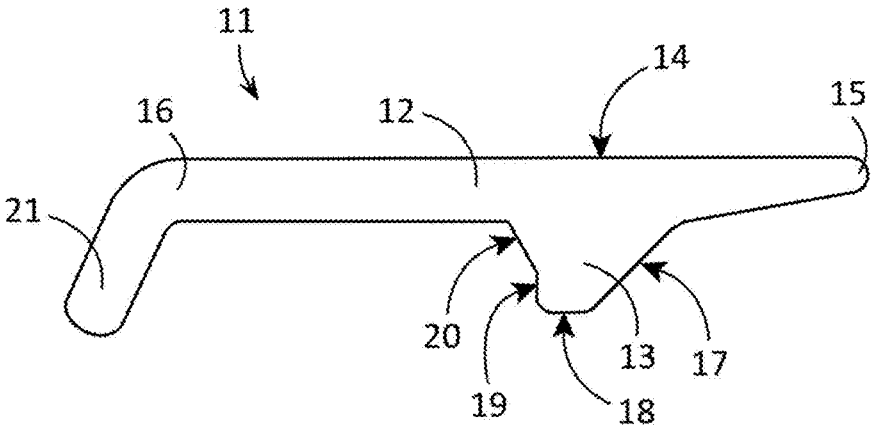
FIG. 4 depicts a side elevation view of an example of a base clip according to various embodiments described herein.
Figure 5:
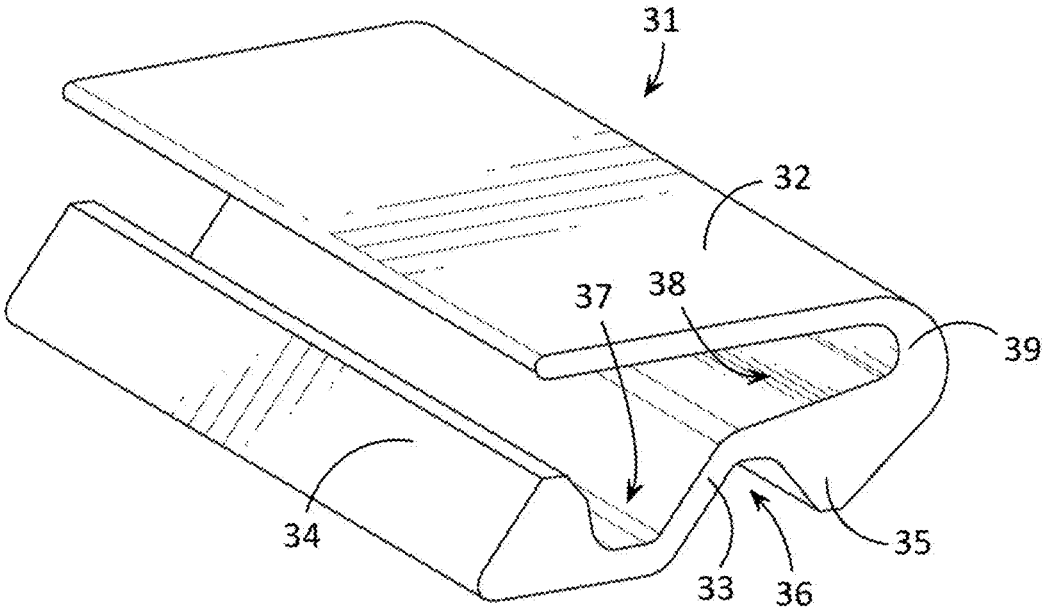
FIG. 5 illustrates a top perspective view of an example of a cover clip according to various embodiments described herein.
Figure 6:
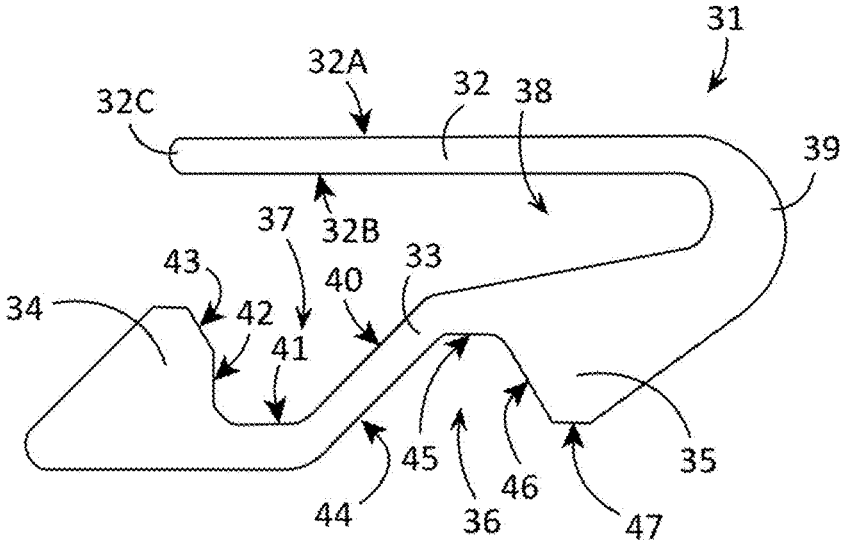
FIG. 6 shows a side elevation view of an example of a cover clip according to various embodiments described herein.
Figure 7:
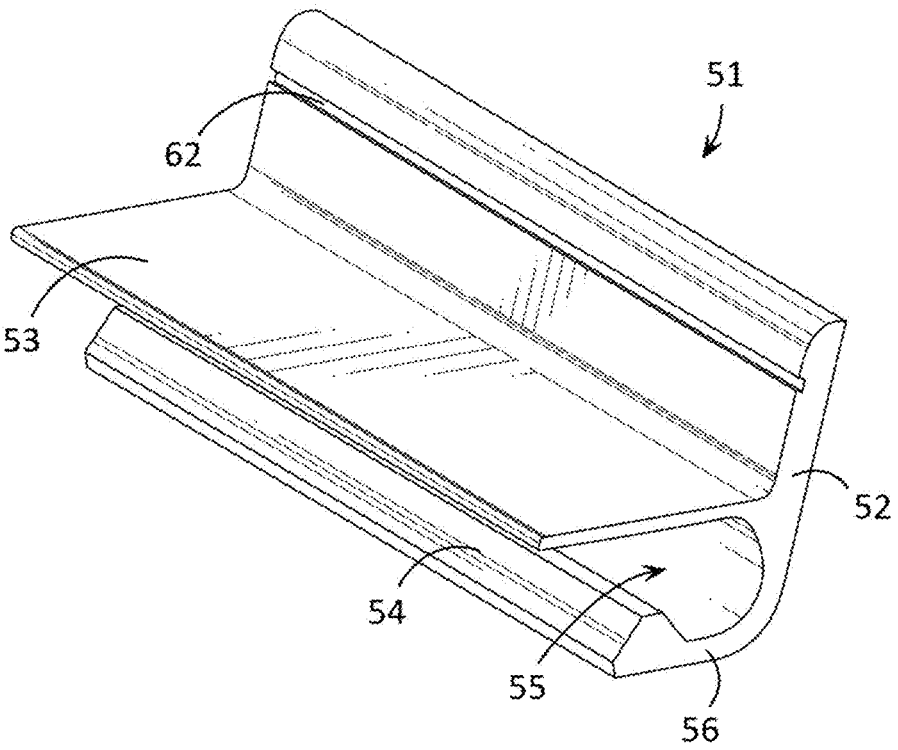
FIG. 7 depicts a top perspective view of an example of a rail according to various embodiments described herein.
Figure 8:
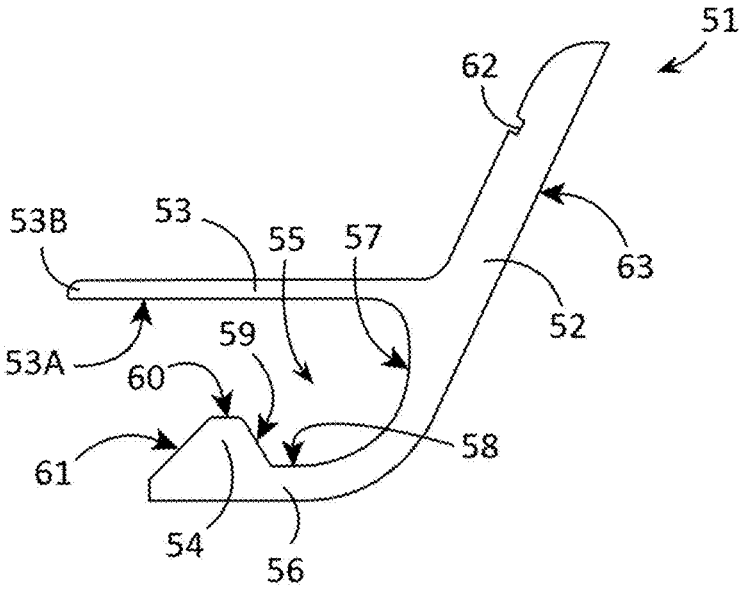
FIG. 8 illustrates a side elevation view of an example of a rail according to various embodiments described herein.

In some embodiments, and as perhaps best shown in FIG. 2, the system 100 may include a base clip 11, a cover clip 31, and a rail 51. A rail 51 may have a back plate 52, a central plate 53, a rail ridge 54, a cover channel 55, and a lower plate 56. The central plate 53 may be coupled to the back plate 52 and may extend away from the back plate 52. The lower plate 56 may be coupled to the back plate 52 and may extend away from the back plate 52. The rail ridge 54 may be coupled to the lower plate 56 so that the rail ridge 54 extends towards the central plate 53, and the cover channel 55 may be formed between the rail ridge 54, the back plate 52, the central plate 53, and the lower plate 56. A base clip 11 may have a base plate 12, a base ridge 13, a base upper surface 14, and the base plate 11 may comprise a first end 15 and a second end 16. The base upper surface 14 and the base ridge 13 may be disposed on opposite sides of the base plate 12, and the base ridge 13 may extend away from the base plate 12. A cover clip 31 may have a cover top plate 32, a cover bottom plate 33, a first cover ridge 34, a second cover ridge 35, a rail channel 36, a base channel 37, and a clip channel 38, and the cover clip 31 may be configured to be coupled to the base clip 11 and to the rail 51. The cover top plate 32 and the cover bottom plate 33 may be coupled together at a cover junction 39, and the clip channel 38 may be formed between the cover top plate 32 and the cover bottom plate 33. The first cover ridge 34 may be coupled to the cover bottom plate 33 so that the first cover ridge 34 extends towards the cover top plate 32, and the base channel 37 may be formed between the cover bottom plate 33 and the first cover ridge 34. The first cover ridge 34 and the second cover ridge 35 may be coupled to opposing sides of the cover bottom plate 33, and the rail channel 36 may be formed between the cover bottom plate 33 and the second cover ridge 35.

Figure 9:
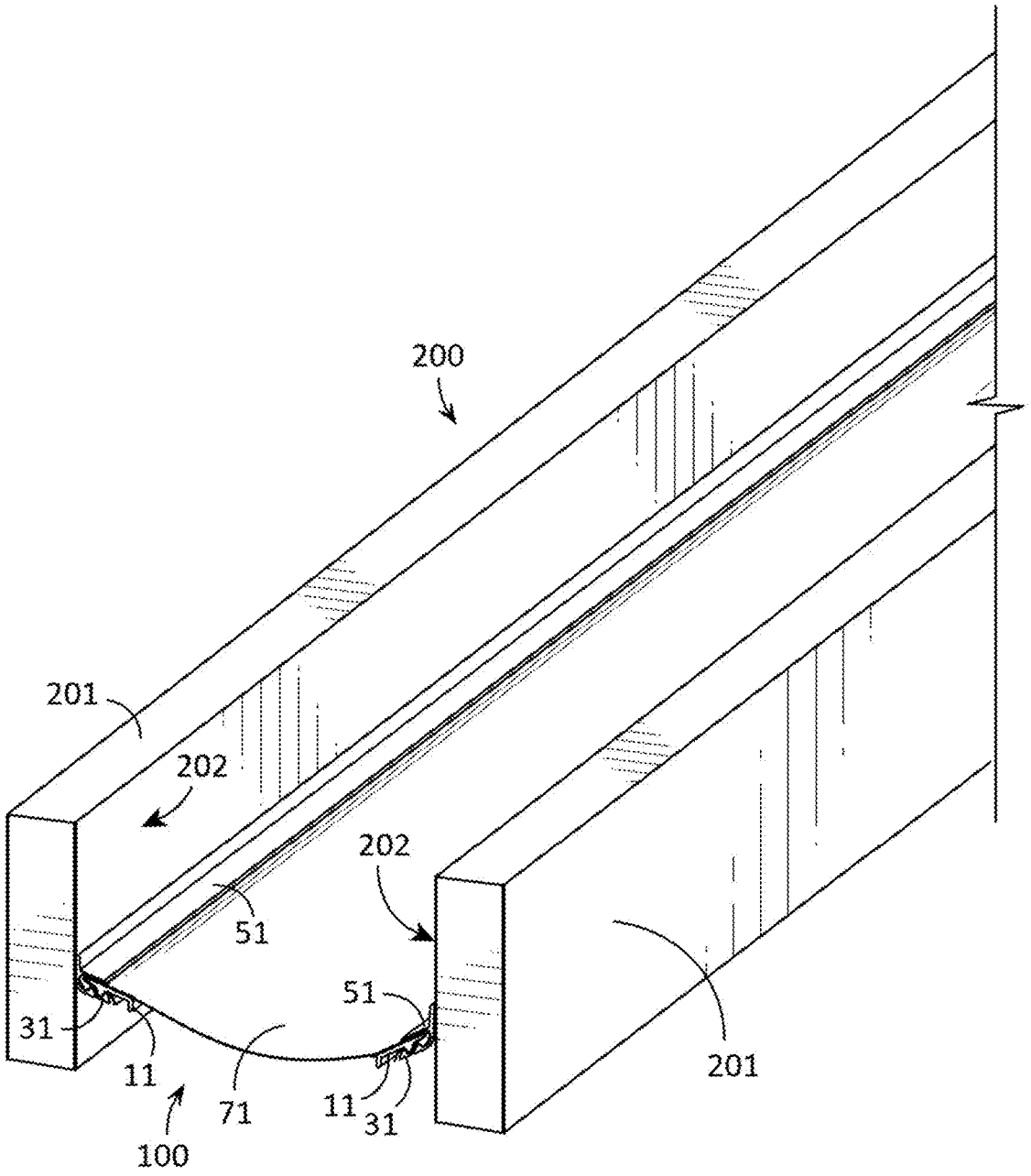
FIG. 9 shows a top perspective view of an example of a water drainage system having an optional waterproof membrane that is coupled between two joists of a deck with a portion of a waterproof membrane tensioned between the joists according to various embodiments described herein.

In further embodiments, and as perhaps best shown in FIGS. 1 and 9, the system 100 may include a waterproof membrane 71, and the waterproof membrane 71 may be coupled to the cover clip and the base clip when the waterproof membrane is positioned between the cover clip and the base clip and when the cover clip and the base clip are coupled together.

Optionally, the system 100 may comprise one or more waterproof membranes 71. Generally, a waterproof membrane 71 may comprise a generally flexible material that may be waterproof. In preferred embodiments, a waterproof membrane 71 may be made from or may comprise polymer sheeting, such as Polypropylene (PP), Medium Density Polyethylene (MDPE), Linear Low-Density Polyethylene (LLDPE), Low Density Polyethylene (LDPE), High Density Polyethylene (HDPE), any other polyethylene, Polyvinyl chloride, or any other flexible polymer material that may be waterproof.

Preferably, a waterproof membrane 71 may be elongated in length and may be coupled between two objects, such as between two joists 201 of a deck 200, as shown in FIG. 9, via a plurality of clips 11, 31, and rails 51. The rails 51 may be coupled to two joists 201 of a deck 200 via a plurality of fasteners, such as nails, screws, staples, rivets, etc., and portions of two sides of the length of a waterproof membrane 71 may be coupled to the one or more rails 51 that are coupled to the two joists 201 via positioning portions of the two sides of the length of a waterproof membrane 71 between the clips 11, 31, and then coupling the clips 11, 31, together and then engaging the cover clips 31 to the rails 51 with the portions of the two sides of the waterproof membrane 71 tensioned or compressed between the clips 11, 31, and also coupled to the rails 51.

The system 100 may include one or more base clips 11. In some embodiments, a base clip 11 may have a base plate 12, a base ridge 13, a base upper surface 14, and the base plate 11 may comprise a first end 15 and a second end 16. The base ridge 13 may be coupled to the base plate 12 so that the base upper surface 14 and the base ridge 13 may be disposed on opposite sides of the base plate 12, and the base ridge 13 may extend away from the base plate 12. Preferably, a base upper surface 14 may be planar in shape (may be approximately a flat surface, also called a plane). A base clip 11 may be configured in any size and shape. Preferably, a base clip 11 may have a length that is less than the length of a rail 51 (with the length dimension of the rail 51 being the largest dimension of the rail 51). For example, a base clip 11 may have a length that is approximately 10 percent of the length of a rail 51 so that two or more, such as a plurality of, base clips 11 may be coupled to a rail 51 via one or more cover clips 31.

A base ridge 13 may comprise a projection that extends away from the base upper surface 14 and may be configured in any size and shape. In some embodiments, a base ridge 13 may comprise one or more surfaces, such as a first base ridge surface 17, a second base ridge surface 18, a third base ridge surface 19, and a fourth base ridge surface 20. Preferably, the first base ridge surface 17 and the fourth base ridge surface 20 may be coupled to the base plate 12, while the second base ridge surface 18 may be coupled to both the first base ridge surface 17 and the third base ridge surface 19 and the third base ridge surface 19 may also be coupled to the fourth base ridge surface 20. In preferred embodiments, the base ridge 13 may be positioned between the first end 15 and the second end 16 of the base plate 12.

In some embodiments, the base clip 11 may comprise a base projection 21 that may be coupled to the second end 16 of the base plate 12. Generally, a base projection 21 may comprise a projection of material which may be angled down (shown angled down approximately 45 degrees in FIG. 4 relative to a planar shaped base upper surface 14) and extending away from the base upper surface 14.

The system 100 may include one or more cover clips 31. In some embodiments, a cover clip 31 may have a cover top plate 32, a cover bottom plate 33, a first cover ridge 34, a second cover ridge 35, a rail channel 36, a base channel 37, and a clip channel 38, and the cover clip 31 may be configured to be coupled to both the base clip 11 and to the rail 51. The cover top plate 32 and the cover bottom plate 33 may be coupled together at a cover junction 39, and the clip channel 38 may be formed between the cover top plate 32 and the cover bottom plate 33. The first cover ridge 34 may be coupled to the cover bottom plate 33 so that the first cover ridge 34 extends towards the cover top plate 32, and the base channel 37 may be formed between the cover bottom plate 33 and the first cover ridge 34. The first cover ridge 34 and the second cover ridge 35 may be coupled to opposing sides of the cover bottom plate 33, and the rail channel 36 may be formed between the cover bottom plate 33 and the second cover ridge 35.

The cover top plate 32 may have a cover plate upper surface 32A and a cover plate lower surface 32B that may be positioned on opposite sides of the cover top plate 32. The cover plate upper surface 32A may face away from the clip channel 38 and the cover plate lower surface 32B may face the clip channel 38 and form a portion of the clip channel 38. Preferably, a cover plate upper surface 32A and/or a cover plate lower surface 32B may be planar in shape.

A first cover ridge 34 may comprise a projection that extends away from the cover bottom plate 33 towards the cover top plate 32, and the first cover ridge 34 may be configured in any size and shape. A base channel 37 may be formed between the cover bottom plate 33 and the first cover ridge 34. Preferably, the base channel 37 may be formed by a first base channel surface 40 of the cover bottom plate 33, by a second base channel surface 41 of the cover bottom plate 33, and by a third base channel surface 42 of the first cover ridge 34. Optionally, the first cover ridge 34 may include a fourth base channel surface 43 which may form a portion of the base channel 37.

A second cover ridge 35 may comprise a projection that extends away from the cover bottom plate 33, away from the cover top plate 32, and away from the clip channel 38. The second cover ridge 35 may be configured in any size and shape. A rail channel 36 may be formed between the cover bottom plate 33 and the second cover ridge 35. Preferably, the rail channel 36 may be formed by a first rail channel surface 44 of the cover bottom plate 33, by a second rail channel surface 45 of the cover bottom plate 33, and by a third rail channel surface 46 of the second cover ridge 35. Optionally, the second cover ridge 35 may include a fourth rail channel surface 47 which may be coupled to the third rail channel surface 46.

The system 100 may include one or rails 51. In some embodiments, a rail 51 may have a back plate 52, a central plate 53, a rail ridge 54, a cover channel 55, and a lower plate 56. The central plate 53 may be coupled to the back plate 52 and may extend away from the back plate 52. The lower plate 56 may be coupled to the back plate 52 and may extend away from the back plate 52 in approximately the same direction as the central plate 53 so that the central plate 53, lower plate 56, and rail ridge 54 are positioned on the same side of the back plate 52. In some embodiments, the rail 51 may comprise a fastener depression 62 which may comprise a recess, a channel, an aperture, or other depression that may be formed into the back plate 52. Generally, a fastener depression 62 may receive one or more fasteners, such as nails, screws, staples, rivets, etc., that may be used to couple a back plate exterior surface 63 of the rail 51 to a deck 200, such as to a joist surface 202 of a joist 201 of the deck 200.

The rail ridge 54 may be coupled to the lower plate 56 so that the rail ridge 54 extends towards the central plate 53, and the cover channel 55. A rail ridge 54 may comprise a projection that extends away from the lower plate 56 and towards the central plate 53. The rail ridge 54 may be configured in any size and shape. A cover channel 55 may be formed between the rail ridge 54, the back plate 52, the central plate 53, and the lower plate 56. Preferably, the cover channel 55 may be formed by: a central plate lower surface 53A of the central plate 53; a back plate interior surface 57 of the back plate 52; a lower plate interior surface 58 of the lower plate 56; and a first rail ridge surface 59 of the rail ridge 54. Optionally, the rail ridge 54 may include a second rail ridge surface 60 which may be coupled to the first rail ridge surface 59. Optionally, the rail ridge 54 may include a third rail ridge surface 61 which may be coupled to the second rail ridge surface 60.

The base clip 11 is configured to be coupled to the cover clip 31. When a portion of waterproof membrane 71 is positioned between the base clip 11 and the cover clip 31, and when the base clip 11 and the cover clip 31 are coupled together, the portion of waterproof membrane 71 may be coupled to the base clip 11 and the cover clip 31. In some embodiments, the base clip 11 may be configured to be coupled to the cover clip 31 by inserting the first end 15 of the base plate 12 into the clip channel 38 of the cover clip 31 and by inserting the base ridge 13 into the base channel 37 of the cover clip 31. In some embodiments, when a portion of waterproof membrane 71 is not positioned between the base clip 11 and the cover clip 31, the cover plate lower surface 32B may contact the base upper surface 14 when the base clip 11 and the cover clip 31 are coupled together as shown in FIG. 2. In some embodiments, a waterproof membrane 71 may be coupled to the cover clip 31 and to the base clip 11 when the waterproof membrane 71 is positioned in the clip channel 38 and in the base channel 37 so that the waterproof membrane 71 is positioned between the cover clip 31 and the base clip 11 when the cover clip 31 and the base clip 11 are coupled together as perhaps best shown in FIG. 1.

The cover clip 31 is configured to be coupled to the rail 51. In some embodiments, the cover clip 31 may be configured to the coupled to the rail 51 by inserting the cover junction 39 of the cover clip 31 into the cover channel 55 of the rail 51 and by inserting the rail ridge 54 of the rail 51 into the rail channel 36 of the cover clip 31. In some embodiments, the cover plate upper surface 32A contacts the central plate lower surface 53A when the cover clip 31 and the rail 51 are coupled together. In some embodiments, the cover junction 39 contacts the back plate interior surface 57 of the back plate 52 when the cover clip 31 and the rail 51 are coupled together. In some embodiments, the second cover ridge 35 contacts the lower plate interior surface 58 of the lower plate 56 when the cover clip 31 and the rail 51 are coupled together.

In preferred embodiments, a base clip 11, a cover clip 31, and/or a rail 51 may comprise a resilient material which may enable one or more elements of the base clip 11, cover clip 31, and/or rail 51 bend and flex or otherwise be moved relative to another element. In some embodiments, the cover top plate 32 may comprise a distal end 32C that is distal to the cover junction 39, and the cover top plate 32 and/or other portion of the cover clip 31 comprises a resilient material so that the distal end 32C of the cover top plate 32 is able to be flexed towards and away from the cover bottom plate 33. In some embodiments, the central plate 53 may comprise a distal end 53B that is distal to the back plate 52, and the central plate 53 and/or other portion of the rail 51 comprises a resilient material so that the distal end 53B of the central plate 53 is able to be flexed towards and away from the rail ridge 54.

Generally, a resilient material may be flexible to allow slight deformation and resilient so as to return to its original shape after deformation. Example resilient materials may include: natural rubber materials, such as latex rubber, forms of the organic compound isoprene, such as polyisoprene, and the like; synthetic rubber materials, such as Polyacrylate Rubber, Ethylene-acrylate Rubber, Polyester Urethane, Bromo Isobutylene Isoprene, Polybutadiene, Chloro Isobutylene Isoprene, Polychloroprene, Chlorosulphonated Polyethylene, Epichlorohydrin, Ethylene Propylene, Ethylene Propylene Diene Monomer, Polyether Urethane, Perfluorocarbon Rubber, Fluoronated Hydrocarbon, Fluoro Silicone, Fluorocarbon Rubber, Hydrogenated Nitrile Butadiene, Polyisoprene, Isobutylene Isoprene Butyl, Acrylonitrile Butadiene, Polyurethane, Styrene Butadiene, Styrene Ethylene Butylene Styrene Copolymer, Polysiloxane, Vinyl Methyl Silicone, Acrylonitrile Butadiene Carboxy Monomer, Styrene Butadiene Carboxy Monomer, Thermoplastic Polyether-ester, Styrene Butadiene Block Copolymer, Styrene Butadiene Carboxy Block Copolymer, and the like; a flexible polymer, such as polytetrafluoroethylene (PTFE), polyethylene terephthalate (PET), high-density polyethylene (HDPE), polyvinyl chloride (PVC), polypropylene (PP), Polystyrene (PS), Polycarbonate (PC), low density polyethylene (LDPE), Polyoxymethylene (POM), Acrylonitrile butadiene styrene (ABS), Polyethylene/Acrylonitrile Butadiene Styrene (PE/ABS), Polycarbonate/Acrylonitrile Butadiene Styrene (PC/ABS), Ultra High Molecular Weight polyethylene, Polyurethanes (PU), Polyamides (PA); or any other suitable flexible natural or synthetic material including combinations of materials, which is flexible to allow slight deformation and resilient so as to return to its original shape after deformation.

As perhaps best shown in FIG. 9, the system 100 of the present invention may be coupled to a deck 200, preferably having one or more joists 201, or other structure and may be configured to direct and divert water, such as water that may drain through a deck 200. The rails 51 may be installed with screw type fasteners on each side of the wood joists 201 that support the deck 200 and may be angled down (preferably down one inch of slope every four feet) to where water will feed into a gutter or other location. Preferably, rails 51 may be approximately four feet long and may be installed or coupled to the interior side of each deck joist 201 and are hidden from view because they are recessed between each joist 201. A lightweight synthetic tear-proof and waterproof membrane 71 may be coupled to the rails 51 via one or more base clips 11 and cover clips 31 to create a "hammock" like gutter between adjacent joists 201. The central plate 53 of the rail 51 preferably angles down to feed water into the waterproof membrane 71 where the water runs down toward the lower end of the waterproof membrane 71 and empties into a gutter or other device or location.

The waterproof membrane 71 may be secured in place to rails 51 by clips 11, 31, such as every eighteen inches. The clips 11, 31, hold the waterproof membrane 71 firmly to the rails 51, but can be easily removed by pushing up or down on the clips 11, 31, to separate the cover clip 31 from the rail 51 and to separate the waterproof membrane 71 from between the clips 11, 31. Removing the clips 11, 31, will free the waterproof membrane 71 to allow for easy cleaning of any debris that may accumulate over time on the waterproof membrane 71 or to replace the waterproof membrane 71 if damaged.

In some embodiments, and as shown in FIG. 2, the system 100 may comprise one or more sealants, such as a first sealant 81 and a second sealant 82. A sealant 81, 82, may comprise adhesive tape, double sided adhesive tape, silicone adhesive, construction adhesive, or any other material that may couple objects together. In some embodiments, a rail 51 may have a first sealant 81, such as a strong ¾" wide double-sided tape, that may be disposed on the on the back of the back plate 52 to the back plate exterior surface 63 that allows the installer (when removing the cover strip) to easily attach the rail 51 to the inside wall joist surface 202 of a wood joist 201. Preferably, a user may sand the joist surface 202 area where the rail 51 will attach to ensure a clean, secure bond of the first sealant 81. In some embodiments, to keep water from running behind the joist 201 and between the rail 51, the system 100 may include a second sealant 82, such as one-sided butyl tape, that may be applied to the full length of the top edge of the back plate 52 of the rail 51 e.g., half of the second sealant 82 would cover the top edge of the rail 51 and the other half may be adhered to the wood joist 201. Optionally, a few small nails or other fasteners may be driven into the top edge of the rail 51 and/or into a fastener depression 62 for extra security. The clips 11, 31, with waterproof membrane 71 may then be snapped into the cover channel 55 of the rail 51.

While some exemplary shapes and sizes have been provided for elements of the system 100, it should be understood to one of ordinary skill in the art that the base clip 11, cover clip 31, rail 51, optional waterproof membrane 71, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the system 100 may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the system 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the system 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the system 100 may be coupled by being one of connected to and integrally formed with another element of the system 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A water drainage system configured to be positioned below a deck, the system comprising:

a rail having a back plate, a central plate, a rail ridge, a cover channel, and a lower plate, wherein the central plate is coupled to the back plate and extends away from the back plate, wherein the lower plate is coupled to the back plate and extends away from the back plate, wherein the rail ridge is coupled to the lower plate so that the rail ridge extends towards the central plate, and wherein the cover channel is formed between the rail ridge, the back plate, the central plate, and the lower plate;

a base clip having a base plate, a base ridge, a base upper surface, wherein the base plate comprises a first end and a second end, wherein the base upper surface and the base ridge are disposed on opposite sides of the base plate, and wherein the base ridge extends away from the base plate; and a cover clip having a cover top plate, a cover bottom plate, a first cover ridge, a second cover ridge, a rail channel, a base channel, and a clip channel, the cover clip configured to be coupled to the base clip and to the rail, wherein the cover top plate and the cover bottom plate are coupled together at a cover junction, wherein the clip channel is formed between the cover top plate and the cover bottom plate, wherein the first cover ridge is coupled to the cover bottom plate so that the first formed between the cover bottom plate and the first cover ridge, wherein the first cover ridge and the second cover ridge are coupled to opposing sides of the cover bottom plate, and wherein the rail channel is formed between the cover bottom plate and the second cover ridge.

2. The system of claim 1, wherein the base clip is configured to be coupled to the cover clip by inserting the first end of the base plate into the clip channel and by inserting the base ridge into the base channel.

3. The system of claim 1, wherein the cover clip is configured to be coupled to the rail by inserting the cover junction into the cover channel and by inserting the rail ridge into the rail channel.

4. The system of claim 1, wherein the cover top plate comprises a cover plate lower surface, and wherein the cover plate lower surface contacts the base upper surface when the base clip and the cover clip are coupled together.

5. The system of claim 1, wherein the cover top plate comprises a cover plate upper surface, wherein the central plate comprises a central plate lower surface, and wherein the cover plate upper surface contacts the central plate lower surface when the cover clip and the rail are coupled together.

6. The system of claim 1, wherein the base clip has a base projection that is coupled to the second end of the base plate.

7. The system of claim 1, wherein the base ridge of the base clip is positioned between the first end and the second end of the base plate.

8. The system of claim 1, wherein the rail comprises a fastener depression.

9. The system of claim 1, wherein the cover junction contacts the back plate when the cover clip and the rail are coupled together.

10. The system of claim 1, wherein the second cover ridge contacts the lower plate when the cover clip and the rail are coupled together.

11. A water drainage system configured to be positioned below a deck, the system comprising:

a rail having a back plate, a central plate, a rail ridge, a cover channel, and a lower plate, wherein the central plate is coupled to the back plate and extends away from the back plate, wherein the lower plate is coupled to the back plate and extends away from the back plate, wherein the rail ridge is coupled to the lower plate so that the rail ridge extends towards the central plate, and wherein the cover channel is formed between the rail ridge, the back plate, the central plate, and the lower plate;

a base clip having a base plate, a base ridge, a base upper surface, wherein the base plate comprises a first end and a second end, wherein the base upper surface and the base ridge are disposed on opposite sides of the base plate, and wherein the base ridge extends away from the base plate;

a cover clip having a cover top plate, a cover bottom plate, a first cover ridge, a second cover ridge, a rail channel, a base channel, and a clip channel, the cover clip configured to be coupled to the base clip and to the rail, wherein the cover top plate and the cover bottom plate are coupled together at a cover junction, wherein the clip channel is formed between the cover top plate and the cover bottom plate, wherein the first cover ridge is coupled to the cover bottom plate so that the first formed between the cover bottom plate and the first cover ridge, wherein the first cover ridge and the second cover ridge are coupled to opposing sides of the cover bottom plate, and wherein the rail channel is formed between the cover bottom plate and the second cover ridge; and a waterproof membrane, wherein the waterproof membrane is coupled to the cover clip and the base clip when the waterproof membrane is positioned between the cover clip and the base clip and when the cover clip and the base clip are coupled together.

12. The system of claim 11, wherein the base clip is configured to be coupled to the cover clip by inserting the first end of the base plate into the clip channel and by inserting the base ridge into the base channel.

13. The device system of claim 11, wherein the cover clip is configured to be coupled to the rail by inserting the cover junction into the cover channel and by inserting the rail ridge into the rail channel.

14. The system of claim 11, wherein the cover top plate comprises a cover plate lower surface, and wherein the waterproof membrane is positioned in contact with the cover plate lower surface and the base upper surface when the base clip and the cover clip are coupled together.

15. The system of claim 11, wherein the cover top plate comprises a cover plate upper surface, wherein the central plate comprises a central plate lower surface, and wherein the cover plate upper surface contacts the central plate lower surface when the cover clip and the rail are coupled together.

16. The system of claim 11, wherein the base clip has a base projection that is coupled to the second end of the base plate.

17. The system of claim 11, wherein the base ridge of the base clip is positioned between the first end and the second end of the base plate.

18. The system of claim 11, wherein the rail comprises a fastener depression.

19. The system of claim 11, wherein the cover junction contacts the back plate when the cover clip and the rail are coupled together.

20. The system of claim 11, wherein the second cover ridge contacts the lower plate when the cover clip and rail are coupled together.

* * * * *